US005651249A

United States Patent [19]

Nagao et al.

[11] Patent Number: 5,651,249

[45] Date of Patent: Jul. 29, 1997

[54] EXHAUST MUFFLER STRUCTURE FOR INTERNAL COMBUSTION ENGINE

[75] Inventors: Yoshiaki Nagao, Tokyo; Yasuharu Sato, Fussa; Kazuhiro Tsutsui, Hachioji, all of Japan

[73] Assignee: Kioritz Corporation, Tokyo, Japan

[21] Appl. No.: 424,670

[22] Filed: Apr. 18, 1995

[30] Foreign Application Priority Data

Apr. 22, 1994 [JP] Japan ..... 6-084679

[51] Int. Cl.[6] ..... F01N 3/28

[52] U.S. Cl. ..... 60/302; 60/299; 181/240; 181/258

[58] Field of Search ..... 60/299, 302; 181/240, 181/258

[56] References Cited

U.S. PATENT DOCUMENTS 3,853,483 12/1974 Cross ..... 60/301

*Primary Examiner*—Douglas Hart

*Attorney, Agent, or Firm*—Armstrong, Westerman, Hattori, McLeland & Naughton

[57] ABSTRACT

An exhaust muffler structure of an internal combustion engine in which a catalyzer is readily and easily mounted and removed to carry out the assembling work of the muffler and the maintenance work such as cleaning and replacing the parts of the muffler with ease; the generation of vibration and noise are to be prevented; and the purification capacity and durability of the catalyzer are to be improved. The exhaust muffler structure comprising: an exhaust muffler having inner and outer exhaust muffler halves which are detachably combined with each other; a communication hole formed on the exhaust muffler for guiding exhaust gas from an internal combustion engine to the exhaust muffler; a cylindrical member having a catalyzer between resilient supporting nets, characterized in that the cylindrical member is disposed in a space in the exhaust muffler with a body of the cylindrical member being supported between the both inner and outer exhaust muffler halves.

2 Claims, 7 Drawing Sheets

EXHAUST MUFFLER STRUCTURE FOR INTERNAL COMBUSTION ENGINE

BACKGROUND OF THE INVENTION

1. Field of the Invention

The present invention relates to an exhaust muffler structure for an internal combustion engine, and more particularly to an exhaust muffler structure for an internal combustion engine such as an air-cooled two-cycle gasoline engine used for working machine like a mower and a chain saw.

2. Description of the Related Art

In recent years, in an internal combustion engine such as an air-cooled two-cycle gasoline engine for a mower and a chain saw also, it has been demanded to provide an oxidizing catalyzer in a muffler to reduce HC (hydrocarbon) content, CO (carbon monoxide) content and the like in combustion gas exhausted from the engine and to purify the exhaust gas.

The present applicant proposed an exhaust muffler structure for an internal combustion engine which was disclosed in the specification of Japanese Utility Model Laid-Open No. Heisei 3-92517 filed prior to the present application. In this exhaust muffler structure, a cylindrical member of which cloth catalyzer is formed by adhering oxidizing catalyzer to a cloth-shaped base material is disposed in the exhaust muffler in such a manner that an exhaust gas guide cylinder is enclosed by the cylindrical member. FIGS. 6 and 7 show such conventional exhaust muffler structure for an internal combustion engine as described above. FIG. 6 is a lateral cross-sectional view showing a primary portion of the conventional exhaust muffler which is attached to a main body of the internal combustion engine, and FIG. 7 is an exploded perspective view of the exhaust muffler illustrated in FIG. 6.

In FIGS. 6 and 7, a heat insulating plate 11 is mounted between the internal combustion engine 20 and the exhaust muffler 10 to prevent heat of the exhaust muffler 10 from transiting to the internal combustion engine 20 and a fuel tank 29, and to guide cooling air in combination with a cylinder cover 27. The exhaust muffler 10 is divided at a lateral joining face 10*c* into two pieces, an inner exhaust muffler half 10*a* on the side of the main body of the internal combustion engine 20 and an outer exhaust muffler half 10*b*. In the above-mentioned inner exhaust muffler half 10*a*, an exhaust gas guide cylinder 13 and a pair of supporting posts 14 and 15 positioned in parallel to the cylinder 13 on both sides thereof. The exhaust muffler guide cylinder 13 is fixed to an inner reinforcing plate 28 which is attached to an inner wall of the inner exhaust muffler 10*a*. A communication hole 16 communicating with the inner reinforcing plate 28 and the exhaust gas guide cylinder 13, an exhaust hole 17 formed on the heat insulating plate 11, and an exhaust port 25 on the side of the main body of the inner combustion engine 20 are in communication with each other. Further, a plenty of small holes 18 are formed on a peripheral wall of the exhaust gas guide cylinder 13 to communicate the inside and outside of the engine 20 with each other.

Stud bolts 21 and 22 projecting from both sides of the exhaust port 25 on the side of the internal combustion engine 20 are inserted into the communication holes of the supporting posts 14 and 15 and the communication hole of the outer exhaust muffler half 10*b* in this order, and nuts 23, 24 are engaged with tips of the stud bolts 21, 22, which causes the inner and outer exhaust muffler halves 10*a* and 10*b* to be integral with each other and sealed. Further, an exhaust muffler cover 26 is detachably mounted on the side of the main body of the internal combustion engine 20.

When integrally combining the inner and outer exhaust muffler halves 10*a* and 10*b*, a substantially cylindrical member 30 of which cloth catalyzer is supported between two wire nets is deformed to a substantial ellipse in such a manner that the exhaust gas guide cylinder 13 is enclosed by the cylindrical member 30, and the cylindrical member 30 is sustained between a pair of the supporting posts 14 and 15.

With the construction described above, exhaust gas generated by the operation of the internal combustion engine is extracted from the exhaust port 25 of the internal combustion engine 20 to the exhaust gas guide cylinder 13 of the exhaust muffler 10. Then, the exhaust gas passes through the small holes 18 of the exhaust gas guide cylinder 13 and further passes through the cloth catalyzer of the cylindrical member 30 to finally be extracted from an exhaust pipe 40 to open air.

SUMMARY OF THE INVENTION

With the construction of the conventional exhaust muffler of an internal combustion engine, however, the cylindrical member 30 is only wound between the pair of the supporting posts 14 and 15 and fixed thereto, and is not supported from outside at all, which causes the cylindrical member 30 to unstably be supported. Another problem is that the dimension of the cylindrical member 30 attached to the supporting posts 14 and 15 is restricted by the lengths of the supporting posts 14 and 15.

Further, the cylindrical member 30 is wound between the pair of the supporting posts 14 and 15 with a tension being applied thereto, causing the assembly work and the maintenance work for replacement of parts not to be easy.

Moreover, the cylindrical member 30 is situated at a high temperature portion adjacent to the exhaust port 25 of the internal combustion engine 20, which provides problems of harmful effect to the catalyzer, resulting in frequent maintenance work for replacement of the parts and the like.

The present invention has been made to eliminate the problems of the conventional exhaust muffler structure of an internal combustion engine describe above, and the object thereof is to provide an exhaust muffler structure of an internal combustion engine in which a catalyzer is readily and easily mounted and removed; the assembling work and the maintenance work such as cleaning and replacement of the parts thereof are easily carried out; the generation of vibration and noise is prevented; and the purifying performance and durability of the catalyzer are improved.

In order to accomplish the above object, the exhaust muffler structure of an internal combustion engine according to the present invention comprising: a box-shaped exhaust muffler having inner and outer exhaust muffler halves which are detachably combined with each other; a communication hole formed on the exhaust muffler for guiding exhaust gas from an internal combustion engine to the exhaust muffler; a cylindrical member having a catalyzer between supporting nets with suitable resilience, characterized in that the cylindrical member is disposed in a space in the exhaust muffler with a body of the cylindrical member being supported between the both inner and outer exhaust muffler halves.

As a more concrete embodiment, the above-mentioned cylindrical member is preferably resiliently supported by reinforcing beads and fastening members for fastening an exhaust gas guide member projecting on the inner surface of the exhaust muffler.

In the aforementioned exhaust muffler structure of an internal combustion engine according to the present invention, the cylindrical member is freely supported in such a manner that the body adjusts itself to the shape of its surrounding portion due to its elastic deformation. Moreover, the cylindrical member is restricted in its position at its body by the reinforcing beads and the fastening members such as nuts, and is restricted in its vertical position by bottom faces of the inner and outer exhaust muffler halves and the exhaust gas guide cylinder as illustrated in FIGS. 1 and 2, so that the cylindrical member is fixed in stable state without shaking. As a result, the work for mounting and removing the cylindrical member is conducted with ease, and the generation of vibration and noise is prevented as well.

BRIEF DESCRIPTION OF THE DRAWINGS

The present invention will be more apparent from the following descriptions with reference to the accompanying drawings wherein.

DETAILED DESCRIPTION OF PREFERRED EMBODIMENT

An exhaust muffler structure according to an embodiment of the present invention will be explained with reference to the drawings.

Figure 1:
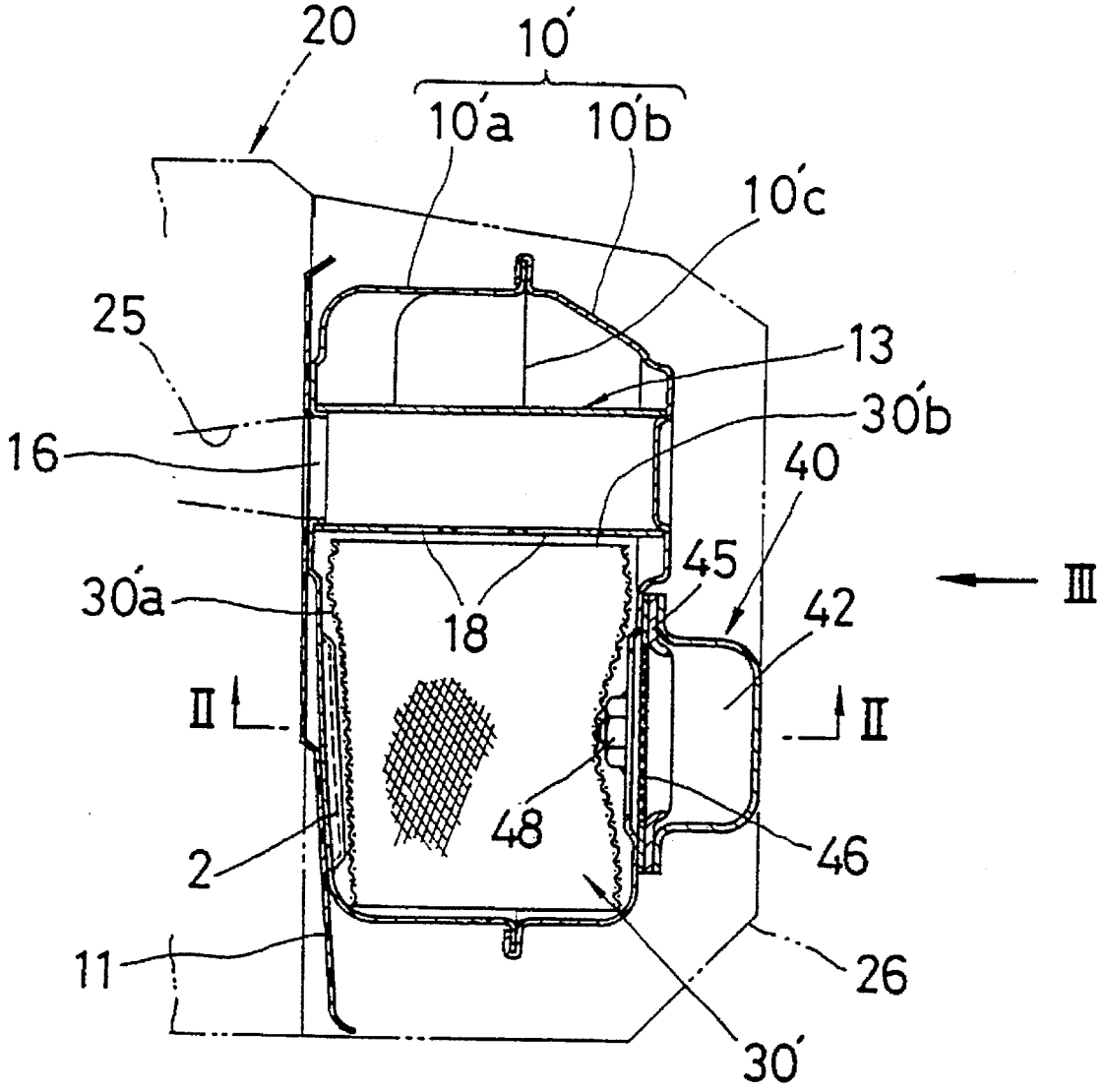
FIG. 1 is a longitudinal cross-sectional view of a primary portion of an exhaust muffler which is attached to an internal combustion engine according to an embodiment of the present invention.
Figure 2:
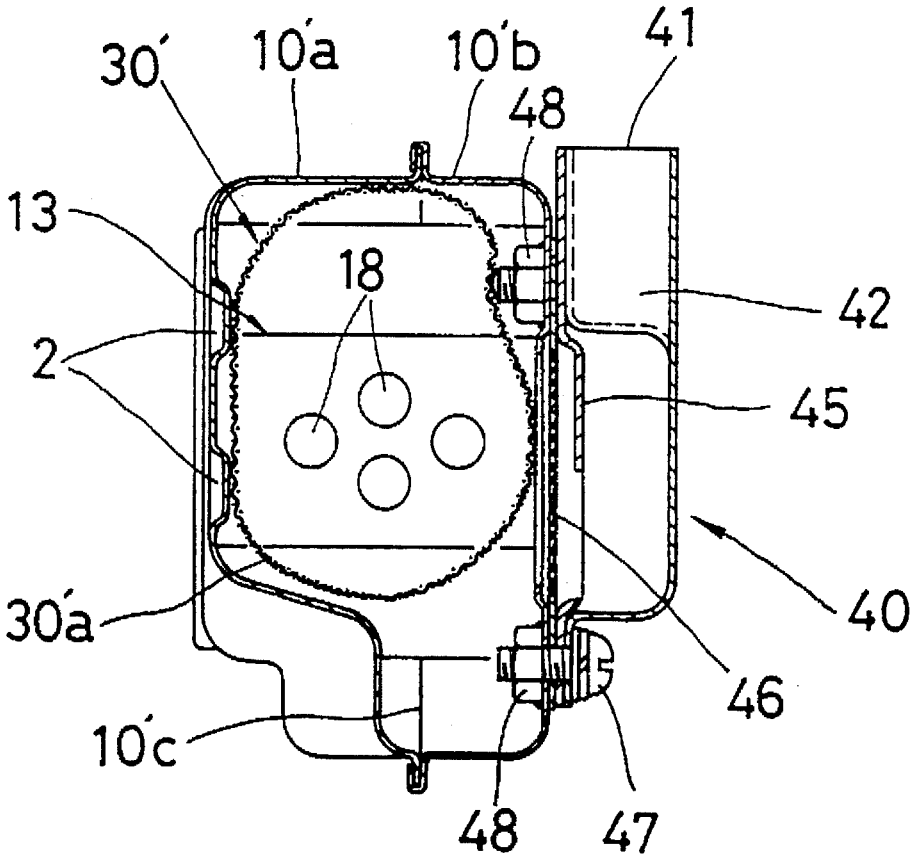
FIG. 2 is a cross-sectional view of the primary portion of the exhaust muffler taken along the line II—II of FIG. 1.
Figure 3:
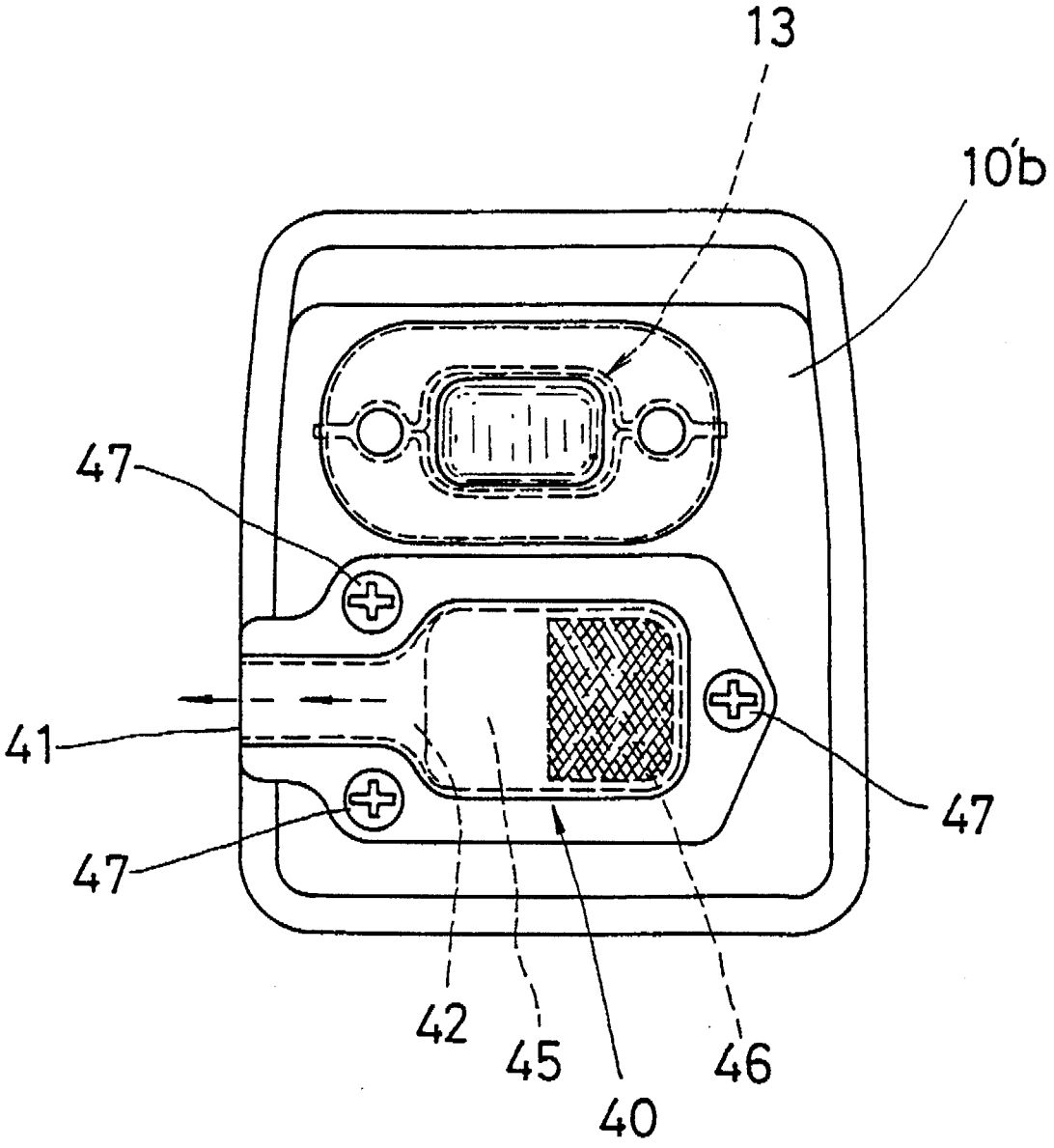
FIG. 3 is a front view of the primary portion of the exhaust muffler observed from the arrow III of FIG. 1.
Figure 4:
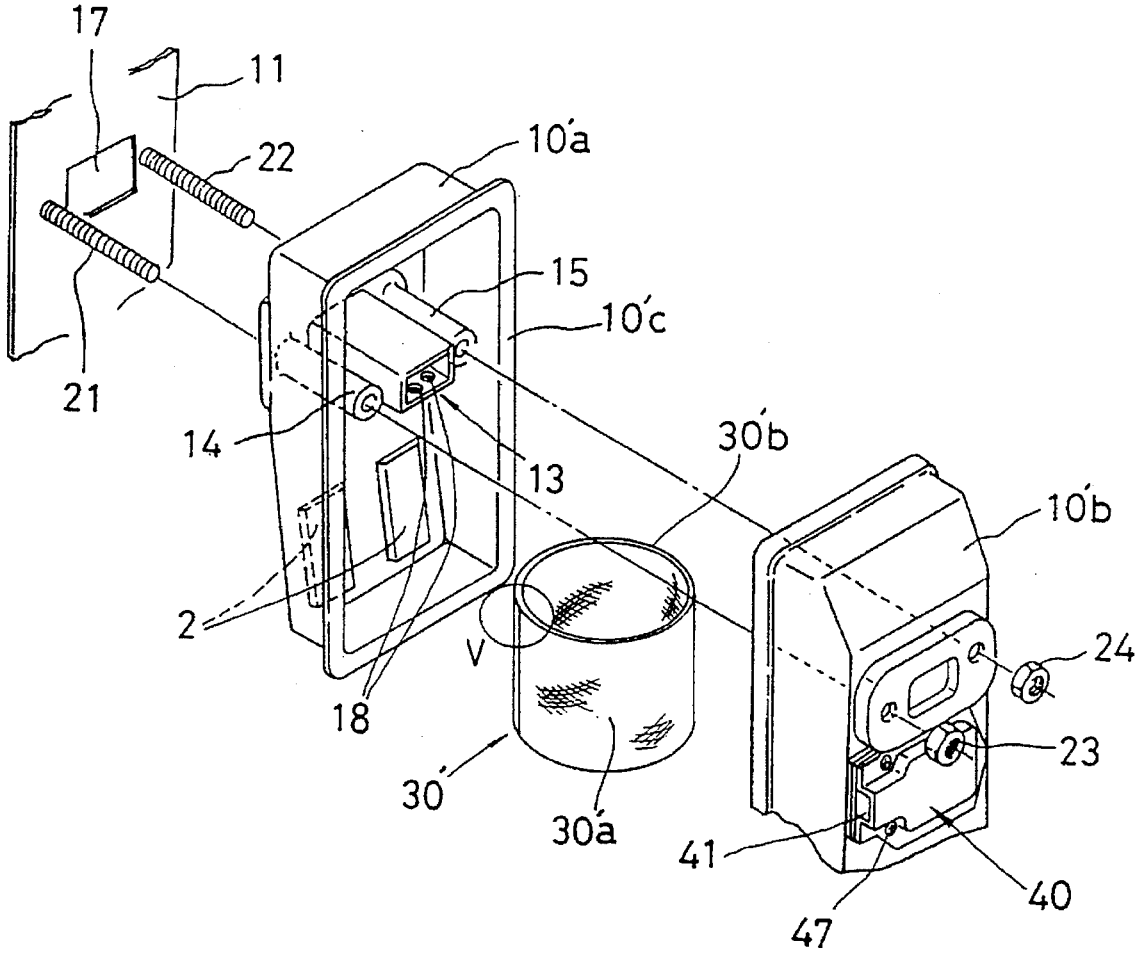
FIG. 4 is an exploded perspective view of the exhaust muffler illustrated in FIGS. 1 to 3.
Figure 6:
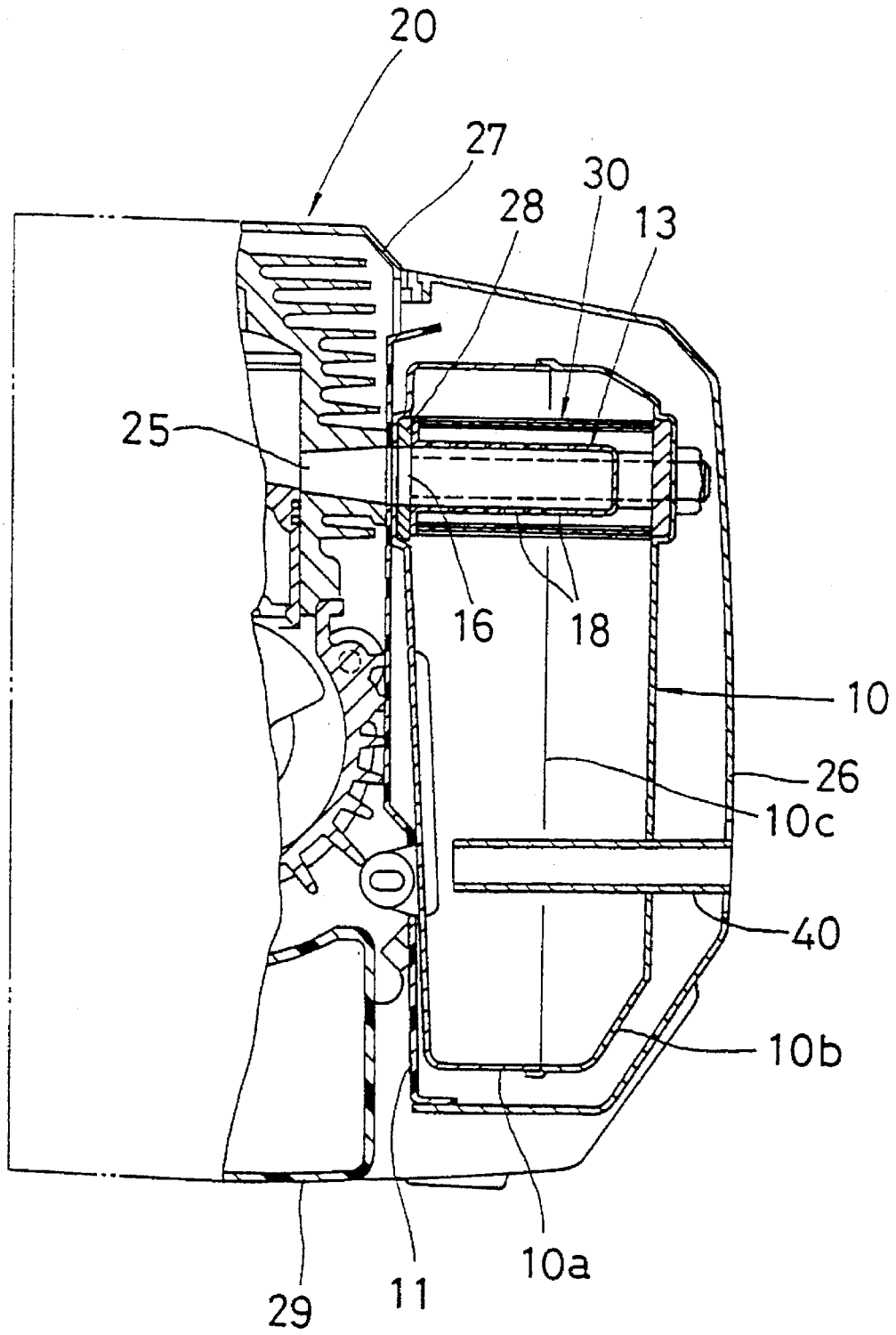
FIG. 6 PRIOR ART
FIG. 6 is a longitudinal cross-sectional view of a primary portion of a conventional exhaust muffler attached to a main body of an internal combustion engine.
Figure 7:
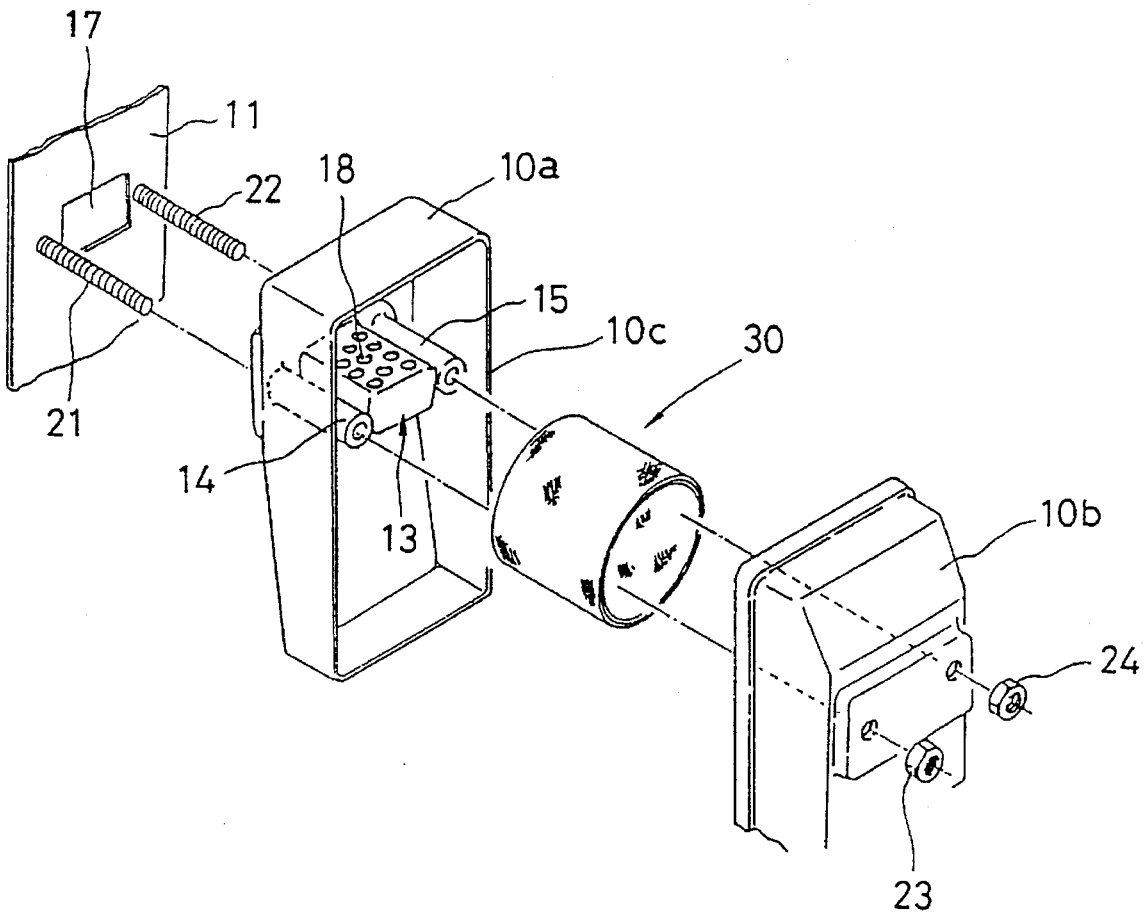
FIG. 7 PRIOR ART
FIG. 7 is an exploded perspective view of the exhaust muffler shown in FIG. 6.

FIG. 1 is a longitudinal cross-sectional view of primary portion of an exhaust muffler of an internal combustion engine according to an embodiment of the present invention. FIG. 2 is a cross-sectional view of the primary portion taken along the line II—II of FIG. 1, and FIG. 3 is a front view of the exhaust muffler observed from the arrow III of FIG. 1. FIG. 4 is an exploded perspective view of the exhaust muffler illustrated in FIGS. 1 to 3, and FIG. 5 is an enlarged view of V portion of FIG. 4. In FIGS. 1 to 5, like reference characters designate like parts of the conventional exhaust muffler of an internal combustion engine shown in FIGS. 6 and 7, and repeated explanation thereof will be omitted. Hereinafter, the differences between the present invention and prior art will mainly be explained.

Convex reinforcing beads 2 are provided below an inner wall of an inner exhaust muffler half 10'*a* according to an embodiment of the present invention. The reinforcing beads 2 project inwardly and extend vertically. A stepped exhaust path 42 with a generally U-shaped cross-section is formed outside of an outer exhaust muffler half 10'*b*. An exhaust gas guide member 40 with an exhaust port 41, for extracting exhaust gas to open air, at a tip thereof is attached to an outer surface of the outer exhaust muffler half 10'*b* through small screws 47 and nuts 48 together with a reinforcing member 45 and a net member (spark arrester) 46.

Figure 5:
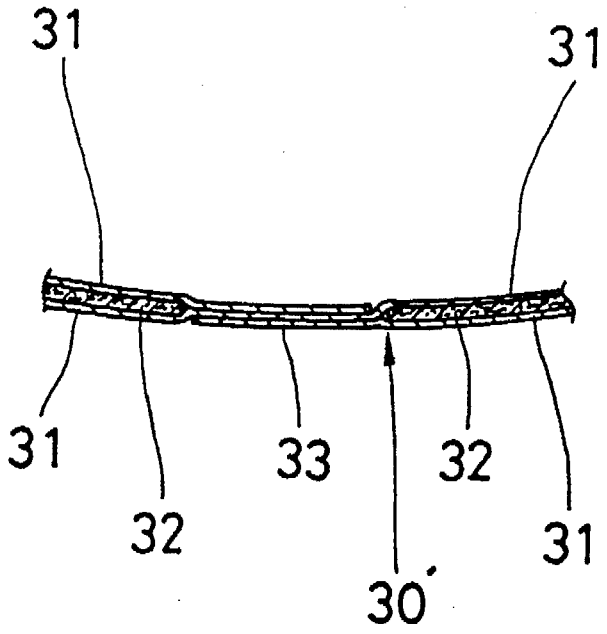
FIG. 5 is an enlarged view of V portion of FIG. 4.

As illustrated in FIG. 5, the cylindrical member 30' has a cloth catalyzer 32 which is inserted between a series of piled supporting nets 31 made of stainless steel or the like with suitable resilient recovery force, and the nets 31 and the cloth catalyzer 32 are spot-welded at overlapped portions 33 to form a substantial cylinder as a whole.

Then, the cylindrical member 30 is inserted between the inner and outer exhaust muffler halves 10'*a* and 10'*b* in such a manner that the axis thereof extends vertically as shown in FIG. 4, and stud bolts 21 and 22 are engaged with nuts 23 and 24 to support the cylindrical member 30' at a body 30'*a* of the cylindrical member 30' with force slightly deforming the body 30'*a*. At the same time, the muffler 10 is thoroughly sealed and the cylindrical member 30' is mounted and fixed.

Next, the function of the exhaust muffler structure of an internal combustion engine according to the embodiment of the present invention with the construction describe above will be explained.

Exhaust gas generated by the operation of the internal combustion engine 20 is introduced from the exhaust port 25 of the internal combustion engine 20 to the exhaust gas guide cylinder 13 in the exhaust muffler 10'. Then, the exhaust gas passes through the small holes 18 of the exhaust gas guide cylinder 13 opposite to an upper opening 30'*b* of the cylindrical member 30' and further passes through the cloth catalyzer 32. Finally, the gas is extracted from the exhaust port 41 by way of the exhaust path 42 out of the exhaust muffler 10' after silenced and purified.

The cylindrical member 30' mounted with the shape illustrated in the drawings is freely supported in such a manner that the body 30'*a* adjusts itself to the shape of its surrounding portions due to its elastic deformation. Moreover, the cylindrical member 30' is restricted in its position from side faces by the reinforcing beads 2 and the nuts 48, and is restricted in its vertical position by bottom faces of the inner and outer exhaust muffler halves 10'*a* and 10'*b* and the exhaust gas guide cylinder 13 as illustrated in FIGS. 1 and 2, so that the cylindrical member 30' is fixed in stable state without shaking. As a result, the assembling work of the cylindrical member 30' and the maintenance work such as cleaning and replacing the parts such as the cylindrical member 30' are conducted with ease, and the generation of vibration and noise is also prevented.

The cylindrical member 30' is located at a distance from the exhaust port 25 of the internal combustion engine 20, and the exhaust gas is blown into the cylindrical member 30' as illustrated in FIGS. 1 and 2, so that the purification performance of the cloth catalyzer 32 is improved while the reduction in the purification capacity thereof is prevented.

While the present invention has been described above in reference to an embodiment thereof, it will be understood by those skilled in the art that changes in design may be made therein without departing from the scope of the invention.

For example, the supporting nets 31 of the cylindrical member 30' to be wound are not limited to double layers, three or four layers may be applicable, and the cloth catalyzer 32 may be inserted between each gap.

Besides a cloth catalyzer, other kinds of catalyzers with suitable resilience may be used.

With the exhaust muffler according to the present invention, a catalyzer is readily and easily mounted and removed to carry out the assembling work of the muffler and the maintenance work such as cleaning and replacing the parts of the muffler with ease; the generation of vibration and noise are to be prevented; and the purification capacity and durability of the catalyzer are to be improved.

What is claimed is:

1. An exhaust muffler structure of an internal combustion engine comprising:

an exhaust muffler having an inner exhaust muffler half and an outer exhaust muffler half which are detachably combined with each other; and a communication hole formed in said inner exhaust muffler half for guiding an exhaust gas from said internal combustion engine to said exhaust muffler, said exhaust gas is introduced into an interior of said exhaust muffler through holes and after having passed a cylindrical catalyzer member at least once, is discharged to the atmosphere through an exhaust gas guide member, wherein said cylindrical catalyzer member is supported at an outer cylindrical surface at an inner wall of said inner exhaust muffler half and at an inner wall of said outer exhaust muffler half.

2. The exhaust muffler structure as set forth in claim 1, wherein said cylindrical catalyzer member is resiliently supported by reinforcing beads and fastening members for fastening said exhaust gas guide member.

* * * * *